US005131157A

United States Patent [19]

Hoagland

[11] Patent Number: 5,131,157

[45] Date of Patent: Jul. 21, 1992

[54] DRAFTING DEVICE

[76] Inventor: Peter S. Hoagland, 18769 Saratoga, Lathrup Village, Mich. 48076

[21] Appl. No.: 711,163

[22] Filed: Jun. 5, 1991

[51] Int. Cl.[5] ..... B43L 7/04

[52] U.S. Cl. ..... 33/448; 33/449

[58] Field of Search ..... 33/448, 449, 450

[56] References Cited

U.S. PATENT DOCUMENTS

| | | | |
|---|---|---|---|
| D. 226,226 | 1/1973 | Hoagland . | |
| D. 232,051 | 7/1974 | Hoagland . | |
| D. 237,364 | 10/1975 | Hoagland . | |
| D. 237,693 | 11/1975 | Hoagland . | |
| D. 237,868 | 12/1975 | Hoagland . | |
| D. 237,950 | 12/1975 | Hoagland . | |
| 684,005 | 10/1901 | Stokes | 33/448 |
| 933,798 | 9/1909 | VanAltena | 33/449 |
| 1,064,006 | 6/1913 | Quirus | 33/449 |
| 2,277,452 | 3/1942 | Pettersen | 33/449 |
| 3,165,839 | 1/1965 | Hoagland | 33/449 |
| 3,482,318 | 12/1969 | Hopkinson | 33/449 |
| 3,726,017 | 4/1973 | DeMathe | 33/449 |
| 3,745,657 | 7/1973 | Gonzalez | 33/449 |

FOREIGN PATENT DOCUMENTS

| | | | |
|---|---|---|---|
| 120308 | 8/1945 | Australia | 33/449 |
| 162002 | 2/1948 | Fed. Rep. of Germany | 33/449 |
| 839007 | 7/1952 | Fed. Rep. of Germany | 33/448 |
| 739955 | 1/1933 | France | 33/448 |

*Primary Examiner*—Thomas B. Will

*Attorney, Agent, or Firm*—Dinnin & Dunn

[57] ABSTRACT

A drafting device includes a body and a roller assembly rotatably mounted on the body for allowing movement of the drafting device across a support surface. The drafting device also includes a spring disposed between the body and roller assembly for producing friction on the roller assembly to resist unintended rolling of the roller assembly.

18 Claims, 1 Drawing Sheet

DRAFTING DEVICE

BACKGROUND OF THE INVENTION

1. Field of the Invention

The present invention relates generally to drafting devices and, more particularly, to a drafting device adapted to move across a support surface.

2. Description of the Related Art

Drafting devices typically include a straight edge for guiding a drafting implement such as a pencil or pen while a line is being drawn. Generally, the drafting device is held against a support surface such as a drafting board. The drafting device may have a raised handle or housing to allow the operator to better grasp the device. Examples of such drafting devices are disclosed in my prior U.S. Pat. Nos. 226,226; 232,051; 237,364; 237,693; 237,868; and 237,950.

Previously, drafting devices have incorporated a structure to move the drafting device easily across the support surface. An example of a drafting device having such a structure is disclosed in my prior U.S. Pat. No. 3,165,839. This patented drafting device included a ruler or body having at least one straight edge and a roller assembly mounted on the body and generally parallel to the straight edge for rolling movement of the body and straight edge across the support surface. The roller assembly included an axle, a pair of rollers mounted to the axle and a driving or actuating wheel mounted on the axle intermediate the rollers for turning the axle and moving the body and straight edge to a desired position. Once in position, an operator's finger is used to overlap the actuating wheel and a nonrotatable portion of the body for firmly holding the body and straight edge in position while a line is being drawn.

One disadvantage of the above patented drafting device is that the operator's finger is required to hold the roller assembly at the precise location for the straight edge. Another disadvantage of the patented drafting device is that the roller assembly rolls freely in the absence of the operator's finger and may be prone to passive movements caused by gravity, vibrations or unintended slips from handling. Therefore, a need exists for a drafting device which resists unintended rolling.

SUMMARY OF THE INVENTION

It is, therefore, one object of the present invention to provide a drafting device with a roller assembly which resists passive movements.

It is another object of the present invention to provide a drafting device which stays precisely where it was left.

It is yet another object of the present invention to provide a drafting device which does not require the operator's finger to hold the roller assembly in place.

It is still another object of the present invention to provide a new and improved drafting device.

To achieve the foregoing objects, the present invention is a drafting device including a body and a roller assembly rotatably mounted on the body for allowing movement of the drafting device across a support surface. The drafting device also includes spring mean for producing friction on the roller assembly to resist unintended rolling of the roller assembly.

One advantage of the present invention is that a spring is provided for the roller assembly to produce friction which will resist unintended rolling of the roller assembly. Another advantage of the present invention is that the friction on the axle may be removed to allow turning of the roller assembly when a predetermined pressure is applied to the body. Yet another advantage of the present invention is that the spring prevents accidental slippage at the instant of touching the drafting device and when releasing it after use. Still another advantage of the present invention is that an operator's finger is not required to hold the roller assembly in place or to prevent the roller assembly from rolling freely. A further advantage of the present invention is that the drafting device stays where it has been placed and is not prone to passive movements caused by gravity, vibrations or unintended slips from handling.

Other objects, features and advantages of the present invention will be readily appreciated as the same becomes better understood after reading the following description when taken in conjunction with the accompanying drawings.

DESCRIPTION OF THE PREFERRED EMBODIMENT(S)

Figure 1:
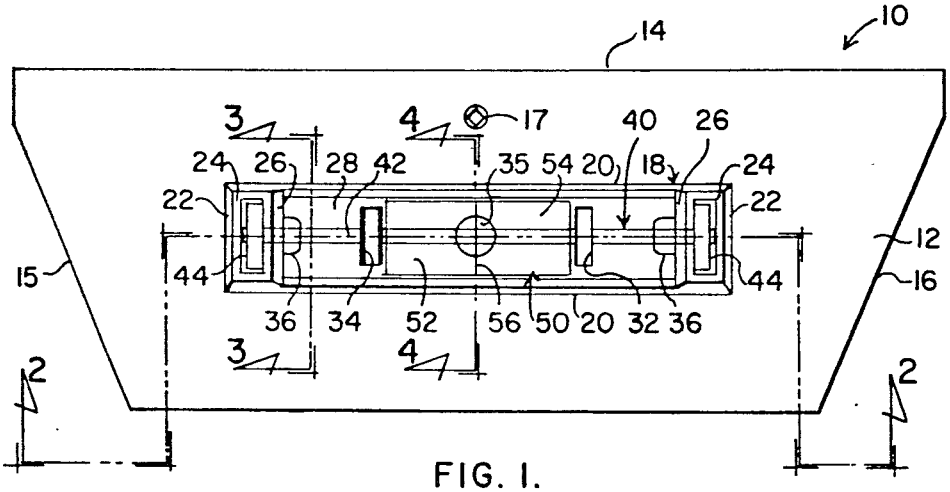
FIG. 1 is a plan view of a drafting device according to the present invention.

Referring to FIG. 1, a drafting instrument or device 10 according to the present invention is shown. The drafting device 10 includes a ruler or body 12 having at least one straight edge 14 for guiding a drafting implement (not shown) such as a pencil or pen while a line is being drawn. The body 12 is generally planar and adapted to be held substantially parallel to a planar support surface such as a drafting board (not shown). The body 12 may also have sides 15 and 16 of a predetermined angulation to provide a generally trapezoidal shape to the body 12. The sides 15 and 16 may be used to guide the drafting implement. It should be appreciated that the body 12 ma have any suitable shape as shown in my prior U.S. Pat. Nos: 226,226; 232,051; 237,364; 237,693; 237,868; and 237,950.

The body 12 may also include a guide aperture 17 extending therethrough. The guide aperture 17 is generally diamond shaped and spaced from and centrally located along the straight edge 14. The guide aperture 17 allows an operator to dispose the drafting implement therein and draw a line substantially perpendicular to the straight edge 14. The body 12 may further include projections (not shown) extending from a bottom surface thereof. The projections are adapted to contact the support surface to limit the movement of the bottom surface of the body 12 relative to the support surface The body 12 is preferably transparent and made of a plastic material such as polycarbonate. The transparent plastic material may be colored, preferably a blue color. It should be appreciated that the body 12 may be made of any suitable material.

Figure 2:
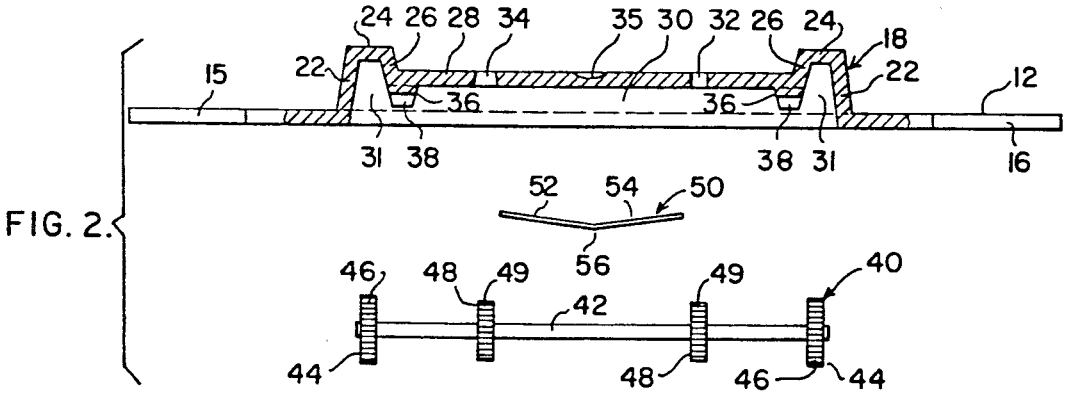
FIG. 2 is an exploded elevational view with portions broken away of the drafting device of FIG. 1.
Figure 3:
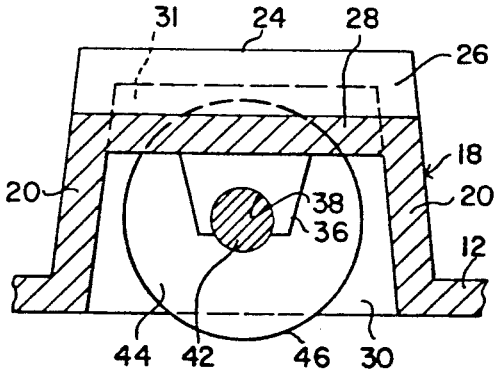
FIG. 3 is a sectional view taken along line 3—3 of FIG. 1.
Figure 4:
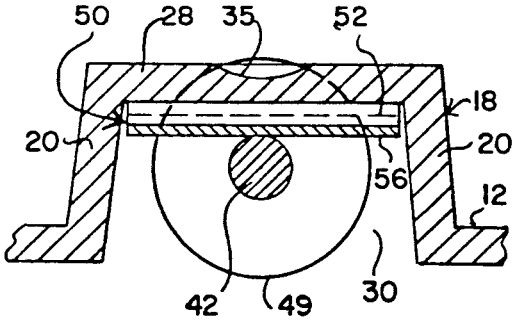
FIG. 4 is a sectional view taken along line 4—4 of FIG. 1.

Referring to FIGS. 2 and 3, the body 12 also includes a raised handle or housing, generally indicated at 18, mounted thereon which extends longitudinal of the body 12 and is spaced laterally from the straight edge 14. The housing 18 is preferably made of the same plastic material as the body 12. Preferably, the housing 18 is integral with the body 12.

The housing 18 is generally rectangular in shape and includes side walls 20, end walls 22, upper top walls 24, interior walls 26 and lower top wall 28 to form a generally rectangular primary cavity 30 and secondary cavity 31 at each end of the primary cavity 30. The secondary cavities 31 have a vertical depth greater than a vertical depth of the primary cavity 30. The side walls 20, end walls 22 and interior walls 26 are generally inclined vertically and the upper top walls 24 and lower top wall 28 are generally horizontal.

The lower top wall 28 includes first and second apertures 32 and 34 spaced longitudinally and extending therethrough. The first and second apertures 32 and 34 are generally rectangular in shape. The second aperture 34 has a width greater than a width of the first aperture 32. The lower top wall 28 also includes a cupped recess 35 disposed centrally therealong for a function to be described. The lower top wall 28 further includes a plurality, preferably a pair, of bearing journals 36 spaced longitudinally and extending inwardly into the cavity 30. The bearing journals 36 are generally trapezoidal in shape and have a journal recess 38 which is generally arcuately shaped for a function to be described. The journal recesses 38 have an opening less than a diameter of the recess.

The drafting device 10 also includes a roller assembly, generally indicated at 40, for allowing parallel movement of the drafting device 10 over the support surface. The roller assembly 40 includes an axle 42 rotatably mounted to the bearing journals 36. The axle 42 is generally cylindrical in shape and extends longitudinally. The axle 42 has a diameter greater than the opening of the journal recess 38 but less than the diameter of the journal recess 38. The axle 42 is disposed within the journal recesses 38 on an axis substantially parallel to the straight edge 14. It should be appreciated that the bearing journals 36 flex to allow the axle 42 to be snap-fit within the journal recesses 38.

The roller assembly 40 also includes a plurality, preferably a pair, of rollers 44 secured to the axle 42 adjacent each end thereof. The rollers 44 are generally circular in shape and have an outer periphery 46 which is ribbed, knurled, serrated or otherwise to provide a friction inducing surface. The rollers 44 are disposed within the secondary cavities 31 of the housing 18. Preferably, the axle 42 and rollers 44 are made of a metal material such as aluminum.

The roller assembly 40 further includes a plurality, preferably a pair, of actuating wheels 48 secured to the axle 42 intermediate the rollers 44. The actuating wheels 48 are longitudinally spaced along the axle 42 and adapted to be aligned with the first and second apertures 32 and 34. The actuating wheels 48 are generally circular in shape and have an outer periphery 49 which is ribbed, knurled, serrated or otherwise to provide a friction inducing surface. The actuating wheels 48 also have a diameter less than a diameter of the rollers 44. Preferably, the actuating wheels 48 are made of a metal material such as aluminum. It should be appreciated that the axle 42, rollers 44 and actuating wheels 48 may be made of any suitable material such as plastic.

The actuating wheels 48 are disposed within the housing 18 and extend through the first and second apertures 32 and 34 and above an upper surface of the lower top wall 28. The actuating wheels 48 are adapted to turn or rotate the axle 42 in response to movement of the actuating wheels 48 by an operator's finger. It should be appreciated that the first aperture 32 has a width slightly greater than a width of the actuating wheel 48 to prevent longitudinal movement of the roller assembly 40 within the housing 18.

The drafting device 10 further includes a spring, generally indicated at 50, for providing friction and resistance to the roller assembly 40. The spring 50 is a blade spring having first and second portions 52 and 54 which are angled or inclined to an apex 56 to form a generally V-shaped cross-section. Preferably, the spring 50 is made of a plastic material such as polycarbonate. It should be appreciated that the spring 50 may be made of any suitable material.

The spring 50 is disposed between the axle 42 and the lower upper wall 28 and centered along the axle 42 between the rollers 44. The first and second portions 52 and 54 contact a lower surface of the lower top wall 28 and the apex 56 of the spring 50 contacts the axle 42. The spring 50 urges the axle 42 and housing 18 away from each other to eliminate slack or vertical play in the bearing journals 36 between the axle 42 and journal recesses 38.

Preferably, the body 12, housing 18 and spring 50 are formed by conventional injection molding. Preferably, the axle 42, rollers 44 and actuating wheels 48 are formed by conventional forming and machining methods. During assembly, the actuating wheels 48 and rollers 44 are press-fit onto the axle 42 such that there is no relative movement between the axle 42, rollers 44 and actuating wheels 48. It should be appreciated that the drafting device 10 may be formed by any suitable means.

In operation, the spring 50 is disposed within the housing 18 such that the first and second portions 52 and 54 contact the lower top wall 28 and the apex 56 is generally centered on the cupped recess 35. The roller assembly 40 is disposed in the primary cavity 30 and secondary cavities 31 of the housing 18. The axle 42 is pressed or snapped into the journal recesses 38 of the bearing journals 36. As a result, the spring 50 is held between the axle 42 and lower top wall 28 and the apex 56 contacts the axle 42. The apex 56 of the spring 50 is generally centered between the rollers 44, urging the housing 18 away from the axle 42 as much as the vertical play in the journal recesses 38 of the bearing journals 3 will allow. The bearing journals 36 contact the axle 42 below the center of the axle 42 at the opening of the journal recesses 38, resulting in friction between the axle 42 and bearing journals 36 which will resist turning of the axle 42. When a finger of an operator presses on the cupped recess 35 of the housing 18 at a predetermined pressure such as 2.3 ounces, contact between the axle 42 and bearing journals 36 shifts from below the center of the axle 42 to the top of the axle 42 and smooth rolling action is restored. The friction reengages instantly when the pressure from the operator's finger is reduced below the predetermined pressure and remains engaged for as long as the pressure is released or until a pressure is applied which exceeds the predetermined pressure.

Accordingly, the spring 50 prevents accidental slippage of the roller assembly 40 at the instant of touching the drafting device 10 and when releasing it after use. The spring 50 provides friction selectively to the axle 42. The spring 50 prevents passive movement and unintended rolling of the drafting device 10. Further, the spring 50 and roller assembly 40 may be disassembled and removed from the housing 18.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A drafting device comprising:

a body;

a roller assembly rotatably mounted on said body for allowing movement of said drafting device across a support surface; and a spring disposed between said body and said roller assembly and having first and second portions inclined to an apex to form a generally V-shaped cross-section, said first and second portions contacting said body and said apex contacting said roller assembly for producing friction on said roller assembly to resist unintended rolling of said roller assembly.

2. A device as set forth in claim 1 wherein said roller assembly comprises an axle and a plurality of rollers secured to said axle.

3. A device as set forth in claim 2 wherein said spring is disposed between said body and said axle.

4. A device as set forth in claim 3 wherein said spring is made of a plastic material.

5. A device as set forth in claim 2 wherein said roller assembly includes at least one actuating wheel secured to said axle intermediate said rollers for rotating said axle.

6. A device as set forth in claim 5 wherein said at least one actuating wheel has a diameter less than a diameter of said rollers.

7. A device as set forth in claim 5 including a housing mounted on said body.

8. A device as set forth in claim 7 wherein said housing comprises side walls, end walls and a top wall to form a cavity.

9. A device as set forth in claim 8 wherein said top wall includes means for rotatably mounting said axle within said housing.

10. A device as set forth in claim 9 wherein said top wall includes at least one aperture extending therethrough, said at least one actuating wheel having a portion of its periphery located in substantially the same plane but slightly above said top wall.

11. A device as set forth in claim 10 including friction inducing surfaces on the periphery of said rollers and said at least one actuating wheel.

12. A device comprising:

a body having a straight edge;

an axle rotatably mounted on said body on an axis substantially parallel to said straight edge;

a plurality of rollers secured to said axle adjacent the ends thereof;

at least one actuating wheel secured to said axle intermediate said rollers for rotating said axle; and a spring disposed between said body and said axle on an axis substantially parallel to said straight edge and having first and second portions inclined to an apex to form a generally V-shaped cross-section, said first and second portions contacting said body and said apex contacting said axle for producing friction on said axle to resist unintended turning of said axle.

13. A device as set forth in claim 12 wherein said body is made of a plastic material.

14. A device as set forth in claim 12 wherein said spring is made of a plastic material.

15. A device as set forth in claim 12 including a housing mounted on said body.

16. A device as set forth in claim 15 wherein said housing includes a plurality of bearing journals for rotatably mounting said axle.

17. A device as set forth in claim 16 wherein said housing includes at least one aperture extending therethrough, said at least one actuating wheel having a portion of its periphery located in substantially the same plane but slightly above said top wall.

18. A drafting device comprising:

a body having a straight edge;

a housing mounted on said body and including side walls, end walls and a top wall to form a cavity;

an axle rotatably mounted on said body on an axis substantially parallel to said straight edge;

a spring disposed within said cavity on an axis substantially parallel to said straight edge;

a plurality of rollers secured to said axle;

a pair of actuating wheels secured to said axle intermediate said rollers for rotating said axle;

said spring having first and second portions inclined to an apex to form a generally V-shaped cross-section, said first and second portions contacting said top wall and said apex contacting said axle to produce friction on said axle to resist unintended turning of said axle;

said top wall including a pair of bearing journals extending into said cavity for rotatably mounting said axle within said housing; and said top wall having a pair of apertures extending therethrough, said actuating wheels having a portion of its periphery located in substantially the same plane but slightly above said top wall.

* * * * *